United States Patent [19]

Stark

[11] Patent Number: 4,481,767

[45] Date of Patent: Nov. 13, 1984

[54] DIESEL EXHAUST CLEANER AND BURNER SYSTEM WITH FLAME DISTRIBUTOR

[75] Inventor: Terrence L. Stark, Washington, Mich.

[73] Assignee: General Motors Corporation, Detroit, Mich.

[21] Appl. No.: 511,883

[22] Filed: Jul. 8, 1983

[51] Int. Cl.[3] ..... F01N 3/02

[52] U.S. Cl. ..... 60/303; 55/294; 55/466; 55/DIG. 10; 55/DIG. 30; 60/311

[58] Field of Search ..... 60/303, 311; 55/283, 55/294, 466, DIG. 10, DIG. 30

[56] References Cited

U.S. PATENT DOCUMENTS

| | | | |
|---|---|---|---|
| 4,220,458 | 9/1980 | Koppelman | 55/283 |
| 4,296,780 | 10/1981 | Norbach | 55/294 |
| 4,335,574 | 6/1982 | Sato et al. | 60/311 |
| 4,345,431 | 8/1982 | Suzuki et al. | 60/286 |
| 4,359,864 | 11/1982 | Bailey | 55/DIG. 30 |
| 4,381,643 | 5/1983 | Stark | 60/303 |
| 4,383,411 | 5/1983 | Riddel | 60/303 |
| 4,415,342 | 11/1983 | Foss | 55/DIG. 10 |

*Primary Examiner*—Douglas Hart
*Attorney, Agent, or Firm*—Arthur N. Krein

[57] ABSTRACT

An exhaust cleaner and burner system for use with a diesel engine has a housing with an inlet at one end for receiving exhaust gas from an engine and an exhaust outlet at its opposite end with a particulate filter positioned therein intermediate the inlet and the exhaust outlet having an inlet face axially spaced from the inlet. A fuel burner device is operatively positioned in the housing in axial spaced apart relationship to the inlet face of the filter and is adapted to be connected to an air/fuel mixture source and has an igniter for the air/fuel mixture. A rotatable flame distributor is operatively associated with the fuel burner device whereby to direct a flame discharged from the fuel burner device incrementally across the inlet face of the filter so as to sequentially effect complete burning of collected particulates.

3 Claims, 3 Drawing Figures

DIESEL EXHAUST CLEANER AND BURNER SYSTEM WITH FLAME DISTRIBUTOR

BACKGROUND OF THE INVENTION

This invention relates to diesel engine exhaust treatment systems, and, in particular, to an exhaust cleaner and burner system with flame distributor for use in collecting and then incinerating particulates discharged with the exhaust gases from a diesel engine.

DESCRIPTION OF THE PRIOR ART

It is known in the art to provide a diesel engine with an exhaust treatment system that includes one or more particulate traps or filters that are operative to filter out and collect particulates from the exhaust gas stream discharged from the engine. Such particulates consist largely of carbon particles that tend to plug the filter, thus restricting exhaust gas flow therethrough. Accordingly, after continued use of such a system for a period of time, dependent on engine operation, it becomes desirable to effect regeneration of the particulate filter.

Regeneration or restoration of such a particulate filter has been accomplished by the use of a suitable auxiliary burner device. For example, an air-fuel nozzle and an ignition device can be used and operated, when desired, to heat the exhaust gases and the particulate filter to the combustion temperature of the collected particulates so as to burn them off the filter surfaces and, accordingly, to thus reopen the flow paths therethrough to again permit normal flow of the exhaust gases through that filter. Alternatively, an electric heater means can be used to generate the additional heat required to initiate the combustion of the trapped particulates.

However, all such prior known burner devices, as used with ceramic wall flow particulate filters, require the use of relatively large quantities of fuel or electrical energy to effect the complete incineration of the particulates collected by this type filter even when additives, such as lead or copper acetate, are added to the diesel fuel to effect a reduction in the ignition temperature of the particulates.

SUMMARY OF THE INVENTION

Accordingly, a primary object of the invention is to provide an improved exhaust cleaner and burner system for use with a diesel engine that advantageously utilizes a rotatable flame sweep distributor to sequentially direct the flame from a fuel burner across the full inlet face of a filter, such as a ceramic wall-flow filter, whereby the particulates in each inlet channel of the filter are ignited.

Another object of the invention is to provide an improved exhaust cleaner and burner system for a diesel engine of the type wherein a ceramic wall-flow particulate trap is used to collect particulates and a fuel burner with a rotatable flame distributor is used to sweep a flame across the inlet face of the filter to effect incineration of the particulates collected by the filter.

For a better understanding of the invention, as well as other objects and further features thereof, reference is had to the following detailed description of the invention to be read in connection with the accompanying drawings.

DESCRIPTION OF A PREFERRED EMBODIMENT

Figure 1:
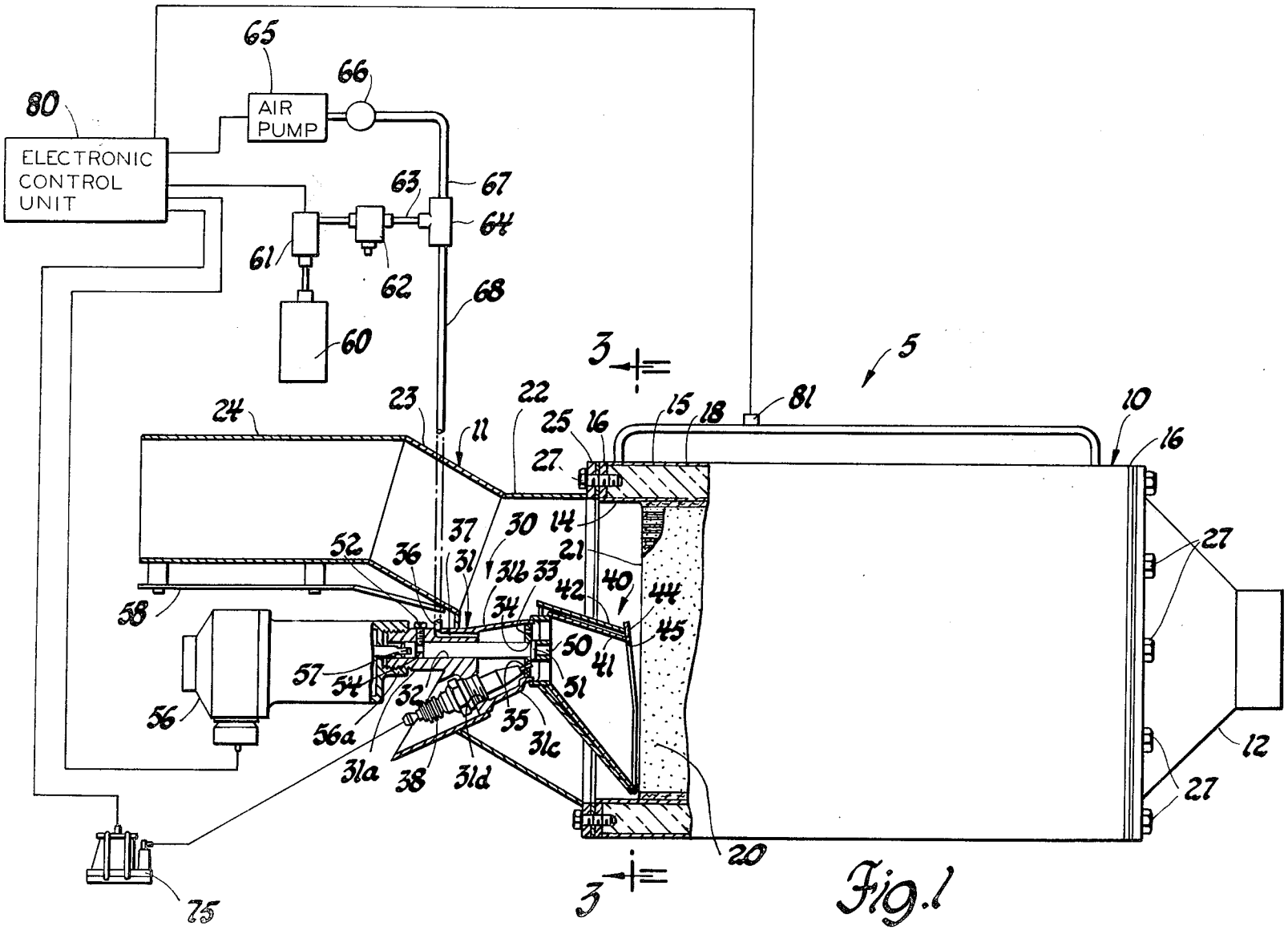
FIG. 1 is a schematic view, with parts broken away, of a diesel exhaust cleaner and burner system with flame distributor in accordance with a preferred embodiment of the invention.

Referring now to FIG. 1 there is illustrated a single path exhaust cleaner and burner system with flame distributor in accordance with the invention for use with a diesel engine.

The exhaust cleaner, generally designated 5, in the construction shown is provided with a tubular trap housing that includes a filter housing 10 having an exhaust inlet 11 at one end and an exhaust outlet 12 at its opposite end.

In the construction shown, the filter housing 10 includes a circular inner shell 14 and an outer shell 15 loosely encircling the inner shell 14, with these shells suitably fixed, as by welding, at their opposite ends to a pair of ring-like flanges 16. Each flange 16 is provided with circumferentially spaced apart, internally threaded apertures 17, only the apertures 17 in the flange 16 at the inlet end of the filter housing being shown.

As shown, a suitable high temperature resistant, thermal insulating material 18 is loosely sandwiched between the inner and outer shells 14 and 15, respectively, along their axial extent between the flanges 16.

A ceramic wall-flow monolith particulate filter 20, of the type shown, for example, in U.S. Pat. No. 4,364,761, entitled "Ceramic Filters for Diesel Exhaust Particulates and Methods of Making", issued Dec. 21, 1982 to Morris Berg, Carl F. Schaefer and William J. Johnston, is suitably supported in a known manner within the inner shell 14 of the filter housing 10 with its inlet end face 21 located a predetermined axial distance from the outboard face of the flange 16 at the inlet end of the filter housing.

Referring now to the exhaust inlet 11, in the construction shown, this exhaust inlet, starting from the right with reference to FIG. 1, includes a tubular transition member 22 having an outlet end portion corresponding in size to that of inner shell 14, an angled intermediate duct member 23 and an inlet passage 24, these elements being suitably secured together, as by welding, into a unitary structure. The transition member 22 at its outlet end, the right hand end with reference to FIG. 1, is suitably secured, as by welding, to a ring mounting flange 25 having circumferentially spaced apart screw receiving apertures 26 therethrough whereby the exhaust inlet 11 is secured to the filter housing 10 by screws 27 which extend through the apertures 26 for threaded engagement in the apertures 17.

With the arrangement of the exhaust inlet 11 shown, its inlet passage 24, which is adapted to be connected so as to receive the exhaust gases discharged from a diesel engine not shown, is radially offset from the longitudinal axis of the filter housing 10, whereby a burner device, to be described in detail next hereinafter, can be mounted in and to the transition member 22.

The burner device, generally designated 30, in accordance with the invention, includes a burner housing 31, of cup-shape, having a base 31*a* of suitable axial extent with an annular shell 31*b* extending therefrom and an integral stud 31*c* extending from these last-identified parts at an inclined angle relative to the axis of a shaft bore 32 that extends through the base 31*a*. A circular support flange 33 with a central shaft bore 34 therethrough and with circumferentially spaced apart apertures 35 is positioned to partly enclose the open end of shell 31*b* and is suitably secured thereto, as by welding.

As shown, the burner housing 31 is supplied with a suitable air-fuel mixture for combustion as by having a suitable mixture inlet fitting 36 threaded into internal threaded end of an air-fuel passage 37 provided for this purpose in the base 31*a* of the burner housing.

A suitable electric igniter, such as a spark plug 38, is suitably secured, as by threaded engagement in an internally threaded bore 31*d* provided in the stud 31*c*, for use in igniting the air-fuel mixture supplied to the burner.

Now as shown in FIG. 1, the transition member 22 is provided with suitable side-by-side apertures 22*a* and 22*b* in the side wall thereof adjacent to its connection to the intermediate duct member 23 so as to receive the base 31*a* of the burner housing 31 and its stud 31*c* portion, the burner housing 31 being suitably secured, as by being welded to the walls of the transition member 22 surrounding these apertures.

With this arrangement, the shaft bores 32 and 34 are aligned substantially coaxial with the longitudinal axis of the filter housing 10 for a purpose which will be described hereinafter.

Now in accordance with a feature of the invention, during operation of the burner device 30, the flame therefrom is discharged by means of a rotatable flame distributor, generally designated 40, so that the flame is caused to sequentially sweep across the full inlet face 21 of the filter 20.

In the embodiment shown, the flame distributor 40 includes an inner distributor shell 41 and an outer distributor shell 42 loosely encircling the inner distributor shell 41, with both being suitably secured at one end, i.e., inboard or left end with reference to FIG. 1, to the rim of an annular spoked hub 43, as by being welded thereto. The rim of this hub is provided with a suitable inside rim diameter so that it can rotatably encircle the outside of the support flange 33. These distributor shells 41 and 42 at their opposite or outboard ends are suitably secured together as by being secured, in the construction shown, to a distributor flange 44, as by being welded thereto.

Figure 2:
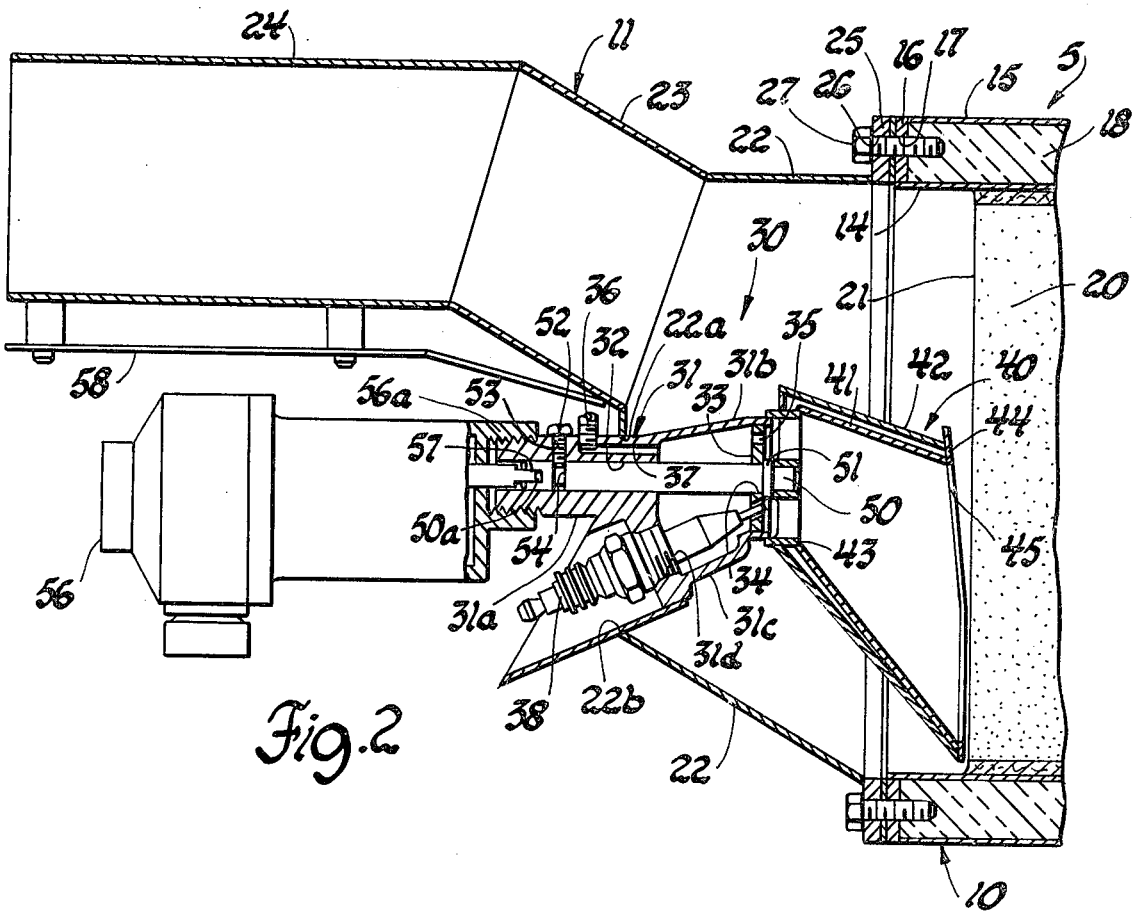
FIG. 2 is an enlarged view of the inlet and burner end of the system of FIG. 1; and, FIG. 3 is an enlarged cross-sectional view of the flame distributor, per se, taken along line 3—3 of FIG. 1.
Figure 3:
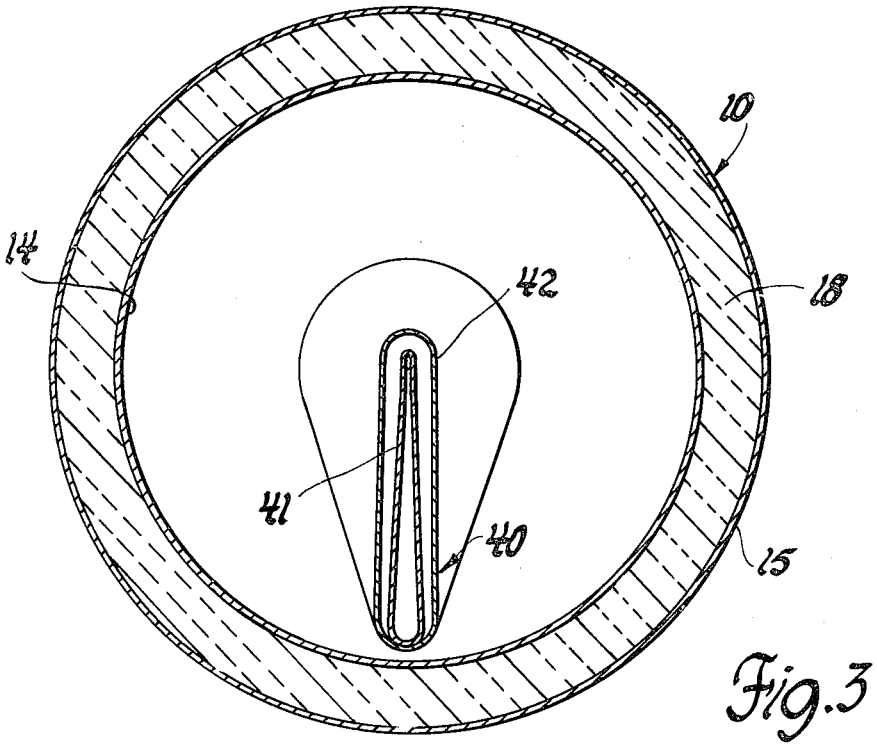

As best seen with reference to FIG. 2, the distributor flange 44 would be provided with a through aperture 45 therein that would be of tapered configuration, being wider at its lower end, with reference to FIG. 3 and tapering inward toward its upper end. As shown, this distributor flange 44 is positioned so that the aperture 45 at its wide end is located closely adjacent to the outer peripheral edge of the inlet face 21 of the filter while its narrow end overlaps the axis of the filter.

Also as shown, the outlet end of the distributor 40, that is, the distributor flange 44 in the construction shown, is in axially spaced apart relationship to the inlet face 21 of the filter 20, as desired, so as to allow exhaust flow into the inlet channels of the filter opposite this outlet end of the distributor. However, this outlet end of the flame distributor 40 is positioned sufficiently close to the inlet filter face, so that exhaust gas flowing around the distributor will not substantially cool the flame or divert its flow direction as directed by the distributor in its rotative sweep across the inlet face of the filter.

The hub 43 is suitably secured, as by welding, to one end of a driven shaft 50, with the hub axially located on the shaft 50 so as to be in abutment against one side of the radial flange 51 on the driven shaft provided adjacent to one end thereof. In the construction shown, the driven shaft 50 is rotatably supported within the shaft bores 32 and 34 of the burner housing 31 and support flange 33, respectively.

As shown, the driven shaft 50 is axially located so that its flange 51 rotatably abuts against the outboard surface of the support flange 33 and it is held against axial movement in the opposite direction, as by means of a guide screw 52 in engagement with an internally threaded bore 53 provided for this purpose in the base 31*a*. As shown, the free end of the guide screw is loosely received in an annular groove 54 provided for this purpose in the driven shaft 50 at an axial location thereon so as to be in substantial alignment with the bore 53.

In the construction shown, the shaft 50 is directly driven by means of a suitable, commercially available, electric motor 56 that has its output shaft provided with opposed flats 57 on the free end thereof which are adapted to extend into driving engagement with a slot 50*a* provided for this purpose on the free or left hand end, with reference to FIG. 1, of the driven shaft 50. In this construction, the motor 56 was a close-coupled motor, that is, its internally threaded output housing 56*a* was threaded onto the externally threaded end of the burner housing base 31*a*.

In the construction illustrated, an exhaust heat shield 58 is suitably secured to the exhaust inlet 11, so as to substantially protect the motor 56 from exhaust heat during engine operation.

In a particular application, the electric motor 56 was suitably geared so as to drive the driven shaft 50 at a speed of ½ RPM. Thus in this particular application, the flame distributor 40 would be rotated 360° every two minutes whereby it would effect a full sweep across the inlet face 21 of the filter during this two minute time span.

Referring again to the burner device 30, it can be supplied with any suitable fuel and in the embodiment illustrated in FIG. 1, this burner device is supplied with propane from a conventional and commercially available canister 60 of pressurized propane, that is connected via a normally closed solenoid actuated on-off valve 61 to the inlet of a pressure regulator 62 which has its outlet connected by a conduit 63 to the leg of an air/fuel mixing tee 64.

In the embodiment shown, air is supplied to the burner device 30 by means of a conventional electric air pump 65 with this air preferably being supplied first to a suitable accumulator 66 and then via a conduit means 67 to a side branch of the mixing tee 64. As should now be apparent, the other side branch of the mixing tee 64 is connected to one end of a conduit 68 the opposite end of which is suitably connected to the inlet fitting 36 whereby the mixture of air and fuel is supplied to the burner device 30.

In the above particular application previously referred to, suitable ignition of the collected particulates on a filter 20, when the diesel engine was operated with diesel fuel containing an additive of approximately 0.50 gms. per gal. of copper acetate, was obtained using approximately 1 CFM of air with propane as the fuel.

Since in the above referred to application only a 1 CFM air pump was used, it was deemed advantageous to continuously operate the air pump 65 during engine operation so as to provide at least some air to the burner device in a continuous manner whereby to prevent particulates from collecting on the internal elements thereof.

Preferably, and as schematically shown in FIG. 1, the electric motor 56, electric air pump 65, the solenoid valve 61, and, the electric igniter 37, via a suitable exciter coil 75, are suitably connected to a source of electric power as controlled by means of an electronic control unit 80, such as an onboard computer, in a manner well known in the art.

For this purpose, the electronic control unit 80 would, in a conventional manner, receive input signals of various engine operating conditions and, in addition, it would preferably also receive suitable signals indicating the pressure differential existing across the particulate filter 20 during engine operation as sensed by a suitable pressure differential gauge 81 operatively connected for communication with inlet and outlet sides of the filter whereby to measure the pressure drop across the filter.

By way of an example, in the particular application referred to hereinabove, the electronic control unit 80 was programmed so as to effect operation of the air pump 65 continuously during engine operation and operation of the burner device 30, that is motor 56, igniter 37, and solenoid 61 so as to effect approximately a two minute regeneration or burn ignition cycle, a time interval sufficient to allow the flame distributor 40 to effect a full sweep of the inlet face 21 of the particulate filter 20.

Because of the operation of the flame distributor 40, which directs the flame from the burner sequentially across the full face of the filter 20 whereby to initiate combustion of collected particulates in each of the inlet channels of the filter, it was discovered that complete incineration of these particulates did not require, as in the past, a substantial heavy deposit of particulates on the filter. That is, with the apparatus shown, it was discovered that with minimum particulate or soot deposits on the filter 20, complete incineration thereof would be accomplished during each burn cycle.

Accordingly, in the particular application referred to, when using a filter 20 with a backpressure thereacross of about 2.5 kPa when clean, the electronic control unit 80, in this example, was programmed so as to initiate the burn ignition cycle when the backpressure across the filter 20 increased to about 5 to 6 kPa at approximately 55 mph vehicle speed as used in a medium duty truck.

While the invention has been described with reference to a particular embodiment disclosed herein, it is not confined to the details set forth since it is apparent that various modifications can be made by those skilled in the art without departing from the scope of the invention. This application is therefore intended to cover such modifications or changes as may come within the purposes of the invention as defined by the following claims.

The embodiments of the invention in which an exclusive property or privilege is claimed are defined as follows:

1. An exhaust cleaner and burner system for use with a diesel engine, said system including a housing having an inlet at one end for receiving exhaust gas from an engine and an exhaust outlet at its opposite end; a filter means positioned in said housing intermediate said inlet and said exhaust outlet and having an inlet face axially spaced from said inlet; a fuel burner means operatively positioned in said housing with its flame discharge end in axial spaced apart relationship to said inlet face; said fuel burner means being adapted to be connected to an air/fuel mixture source and including an igniter means for said air/fuel mixture; and, a rotatable flame distributor means operatively associated with said fuel burner means whereby to direct a flame discharged from said fuel burner means incrementally across the said inlet face of said filter means.

2. An exhaust cleaner and burner system for use with a diesel engine, said system including a cylindrical housing having an inlet at one end for receiving exhaust gas from an engine and an exhaust outlet at its opposite end; a filter means positioned in said housing intermediate said inlet and said exhaust outlet and having an inlet face axially spaced from said inlet; a fuel burner means operatively positioned in said housing and having a flame discharge end located in axial spaced apart relationship to said inlet face; said fuel burner means being adapted to be connected to an air/fuel mixture source and including an igniter means for said air/fuel mixture; a shaft rotatably journaled in said fuel burner means and located substantially coaxial with the central longitudinal axis of said filter, a flame distributor means operatively fixed to one end of said shaft for rotation therewith in position between said flame discharge end and said inlet face, whereby to direct a flame discharged from said fuel burner means, and, drive means connected to the opposite end of said shaft whereby to effect rotation of said flame distributor during operation of said drive means.

3. An exhaust cleaner and burner system for use with a diesel engine, said system including a cylindrical trap housing having an inlet at one end for receiving exhaust gas from an engine and an exhaust outlet at its opposite end; a cylindrical filter means operatively positioned in said housing intermediate said inlet and said exhaust outlet and having an inlet face axially spaced from said inlet; a fuel burner means operatively positioned in said trap housing; said fuel burner means being adapted to be connected to an air/fuel mixture source and including an igniter means for said air/fuel mixture; said burner means including a burner housing having a flame discharge end facing said inlet face and located in axial spaced apart relationship thereto, a shaft rotatably journaled in said burner housing in substantial coaxial alignment with the central axis of said filter, a flame distributor means fixed to one end of said shaft for rotation therewith and operatively located between said flame discharge end and said inlet face, whereby to direct a flame discharged from said fuel burner means onto said inlet face of said filter means and, a drive means operatively connected to the opposite end of said shaft to thereby effect rotation of said flame distributor during operation of said burner means whereby the flame discharged therefrom will be directed incrementally across the full inlet face of said filter.

* * * * *